US011253986B2

(12) United States Patent
Yu

(10) Patent No.: US 11,253,986 B2
(45) Date of Patent: Feb. 22, 2022

(54) HANDLE AND A HAMMERING TOOL

(71) Applicants: HANGZHOU GREAT STAR INDUSTRIAL CO., LTD., Hangzhou (CN); HANGZHOU GREAT STAR TOOLS CO., LTD., Hangzhou (CN)

(72) Inventor: Wentian Yu, Hangzhou (CN)

(73) Assignees: Hangzhou Great Star Industrial Co., Ltd., Zhejiang (CN); Hangzhou Great Star Tools Co., Ltd., Zhejiang (CN)

( * ) Notice: Subject to any disclaimer, the term of this patent is extended or adjusted under 35 U.S.C. 154(b) by 270 days.

(21) Appl. No.: 16/465,550

(22) PCT Filed: Nov. 30, 2016

(86) PCT No.: PCT/CN2016/108023
§ 371 (c)(1),
(2) Date: May 30, 2019

(87) PCT Pub. No.: WO2018/098685
PCT Pub. Date: Jun. 7, 2018

(65) Prior Publication Data

US 2019/0283226 A1 Sep. 19, 2019

(51) Int. Cl.
*B25D 1/12* (2006.01)
*B25G 1/01* (2006.01)
(Continued)

(52) U.S. Cl.
CPC ..... *B25D 1/12* (2013.01); *B25G 1/01* (2013.01); *B25G 1/10* (2013.01); *B25D 1/04* (2013.01)

(58) Field of Classification Search
CPC ... B25G 1/01; B25G 1/02; B25G 1/10; B25G 1/12; B25D 1/12; B25D 1/00; B25D 1/02; B25D 1/04; B25D 1/16
See application file for complete search history.

(56) References Cited

U.S. PATENT DOCUMENTS 2,603,260 A * 7/1952 Floren ..... B25G 1/01 81/22
4,039,012 A * 8/1977 Cook ..... B25G 1/01 81/22
(Continued)

FOREIGN PATENT DOCUMENTS

CN 1203140 A 12/1998
CN 2485112 Y 4/2002
(Continued)

OTHER PUBLICATIONS

International Search Report for PCT/CN2016/108023 dated Sep. 11, 2017.

*Primary Examiner* — Robert J Scruggs
(74) *Attorney, Agent, or Firm* — Blank Rome LLP

(57) ABSTRACT

A handle includes an inner core and a gripping portion disposed around the periphery of the inner core, and at least one chamber is formed between the inner core and the gripping portion. A hammering tool includes the handle. When the hammering tool is used for striking, the internal damping slot of the hammerhead can use a damping material as a first buffering and absorb the vibration and impact force of the hammerhead, which are then delivered to the inner core of the handle, the inner damping layer and its chamber serve as a second buffering and absorb the vibration and impact force delivered from the inner core of the handle, and finally, the outer damping layer serves as a third buffering and absorbs the vibration and impact force delivered from the inner damping layer.

23 Claims, 6 Drawing Sheets

(51) Int. Cl.
*B25G 1/10* (2006.01)
*B25D 1/04* (2006.01)

(56) References Cited

U.S. PATENT DOCUMENTS 4,105,205 A * 8/1978 Theodores ..... A63B 60/54 473/523
5,088,734 A * 2/1992 Glava ..... A63B 49/08 473/523
5,180,163 A * 1/1993 Lanctot ..... A63B 60/16 473/520
5,299,475 A * 4/1994 Stroop ..... B25G 1/102 16/421
5,355,552 A * 10/1994 Huang ..... A63B 49/08 16/421
5,845,364 A * 12/1998 Chen ..... B25G 1/01 16/436
6,477,922 B1 * 11/2002 Burnett ..... B25D 1/00 81/20
8,893,585 B2 * 11/2014 Descombes ..... B25G 1/01 81/22
2004/0244545 A1 * 12/2004 Stinnissen ..... B25G 1/102 81/489
2008/0053278 A1 * 3/2008 St. John ..... B25G 1/01 81/20
2008/0276770 A1 * 11/2008 Blum ..... B25G 1/01 81/489
2012/0222525 A1 * 9/2012 Qiu ..... B25G 1/01 81/489
2016/0167216 A1 * 6/2016 Ou ..... B25G 3/02 81/489

FOREIGN PATENT DOCUMENTS

CN 2495419 Y 6/2002
CN 201559185 U 8/2010
CN 101992462 A 3/2011
CN 104227675 A 12/2014

* cited by examiner

HANDLE AND A HAMMERING TOOL

CROSS REFERENCE TO RELATED APPLICATIONS

This is a U.S. National Stage Application, filed under 35 U.S.C. 371, of International Patent Application No. PCT/CN2016/108023, filed on Nov. 30, 2016, the disclosure of which is incorporated herein by reference in its entirety.

FIELD OF THE INVENTION

The present invention relates to a handle and a hammering tool including the handle.

DESCRIPTION OF THE PRIOR ART

The structures of common hammering tools of iron hammer, wooden hammer, hatchet and the like are mostly composed of a head portion and a handle. In terms of the hammering tool integrally forged by metal, in order to increase the comfortableness of holding the hammering tool by a user, a handle sleeve that is made of plastic materials of plastic, rubber and the like will be sheathed on the handle. The handle sleeve and the handle are in a fixed connection mode. Aside from tight fit, adhesive is further utilized at the same time for adhesion and fixation. However, since the handle sleeve is of plastic or rubber material, while the handle of the hammer tool is of metal material, as can be known from past experiences, when two workpieces of different materials are connected by means of adhesive, since the surface characteristics of interfaces of the fixed connection are different, the adhesion is often poor. Therefore, when a hammer tool is used under the state of collision for a long time, the fixed connection between the handle and the handle sleeve will get loose gradually due to the transverse or vertical throwing force during swinging and the counterforce when striking; in less severe cases, the loosening or drop of the handle sleeve will cause inconvenience for use; in severe cases, the hammering tool will be thrown along the direction of applied force, which will cause unexpected potential dangers.

Secondly, when the aforementioned hammer tool is in use, since the handle connected to the head portion is of compacting rigid structure, part of the counterforce generated by striking of one end of the hammer tool is generally conducted to the holding place where the user holds by means of the handle connected to the head portion, making the user's hand prone to feel discomfort of soreness, paralysis and the like due to shock. Although partial modifications have been done to most of the striking tools to cooperate with the workpieces being acted on to enhance efficacy or avoid injury, among the modifications, damping or antiskid function of the holding portion of these striking tools are most common. It is quite inconvenient that no further improvement has been made to enhance the secure structure between the damping material and the metal holding portion of most striking tools.

SUMMARY OF THE INVENTION

The technical problem to be solved by the present invention is to provide a damping hammering tool having reliable and secure fixation structure for the damping layer of handle, and having triple damping effects.

To solve the above technical problems, the present invention provides a handle, comprising an inner core and a gripping portion disposed around the periphery of the inner core, and at least one chamber is formed between the inner core and the gripping portion.

Further, the chamber is disposed on at least one lateral side of the handle.

Further, a damping material or an airbag is disposed in the chamber.

Further, the damping material is liquid silicone.

Further, compressed air or liquid substance is filled in the internal of the airbag.

Further, the gripping portion comprises an outer damping layer, an inner damping layer is disposed between the outer damping layer and the inner core, and the chamber is disposed in the inner damping layer.

Further, the material of the outer damping layer is thermoplastic polyurethane (TPU) or thermoplastic rubber material (TPR).

Further, the material of the inner damping layer is thermoplastic polyurethane.

Further, the inner damping layer is prefabricated first and then sleeved on the inner core, or is directly injection molded on the inner core in an injection molding mode.

Further, the handle further comprises an external member, which is sheathed on the inner core.

Further, the outer damping layer is prefabricated first and then sleeved on at least one location of the inner damping layer and/or the external member, or is directly injection molded on at least one location of the inner damping layer and/or the external member in an injection molding mode.

Further, the external member is fixed on the inner core by an assembly part.

Further, the inner core is provided with an assembly hole, the external member penetrates the assembly hole and is fixed on the inner core by the assembly part.

Further, the external member is assembled onto inner core along a first direction, the external member is assembled and fixed on the inner core by the assembly part along a second direction, and the first direction is different from the second direction.

Further, the inner core has a locating hole, which is provided at the rear end of the inner core, a locating pin is equipped through the locating hole, and the locating pin is coated and fixed by the outer damping layer.

Further, the locating hole further comprises a locating slot, the locating pin is composed of a first pin member and a second pin member jointed axially, and the first pin member has a lug which is embedded into the locating slot to prevent the locating pin from rotating axially in the locating hole.

Further, the outer damping layer further comprises at least one inspection hole, which corresponds to at least one location of the inner damping layer, for observing the inner damping layer and the chamber.

Further, the handle further comprises an external member sheathed on the inner core, the gripping portion comprises an outer damping layer, the outer damping layer is prefabricated first and then sheathed on at least one location of the external member, or is directly injection molded on at least one location of the external member in an injection molding mode.

Further, an accommodation space is provided between the outer damping layer and the inner core, and the accommodation space is stuffed by a inner damping layer.

Further, the inner core has a locating hole, which is provided at the rear end of the inner core, a locating pin is equipped through the locating hole, and the locating pin is coated and fixed by the outer damping layer.

Further, the rear end of the outer damping layer is connected to a sealing cover, the sealing cover comprises:

a cover portion, for closing the opening of the outer damping layer; and at least one inserting portion, extending out from the cover portion, the inserting portion is inserted into the accommodation space via the opening, the inserting portion is coated and fixed by the outer damping layer.

The present invention further provides a hammering tool, which comprises any one of the above handles, and the hammering tool further comprises a hammerhead connected to the inner core of the handle.

Further, the hammerhead and the inner core are integrally molded.

Further, the internal of the hammerhead has at least one damping slot, and the damping slot is used for stuffing with damping material therein.

Further, a stopping portion is disposed between the hammerhead and the inner core, and the stopping portion is used to confine the location of the external member sheathed on the inner core.

Further, the external member further comprises:

a sleeve head portion, which is limited by the stopping portion and thereby assembled with the stopping portion;

a sleeve joint portion, which is extended out from the sleeve head portion, the sleeve joint portion has a punched hole which matches the assembly hole in the inner core for the assembly part to be equipped through, and the sleeve joint portion is coated and fixed by the outer damping layer; and a through hole, penetrating the sleeve head portion and the sleeve joint portion, which is used for the inner core to be equipped through therein. When the hammering tool provided in the present invention is used for striking, the internal damping slot of the hammerhead may use the damping material as a first buffering and absorb the vibration and impact force of the hammerhead, which are then delivered to the inner core of the handle, the inner damping layer and its chamber serve as a second buffering and absorb the vibration and impact force delivered from the inner core of the handle, and finally, the outer damping layer serves as the third buffering and absorbs the vibration and impact force delivered from the inner damping layer. The vibration and impact force felt by the hand of the user when in operation are dramatically decreased through these three buffering and damping structures.

In addition, the assembling direction (the first direction) of the external member relative to the inner core of the handle is different from the fixation direction (the second direction) of the assembly part fixing the external member, and the sleeve joint portion of the external member and the assembly part are further coated by the outer damping layer, thereby preventing the external member from detaching from the inner core of the handle from the assembly direction.

Detailed description of the technical concept and specific embodiments of the present invention is further provided below in conjunction with the accompanying drawings.

Figure 1:
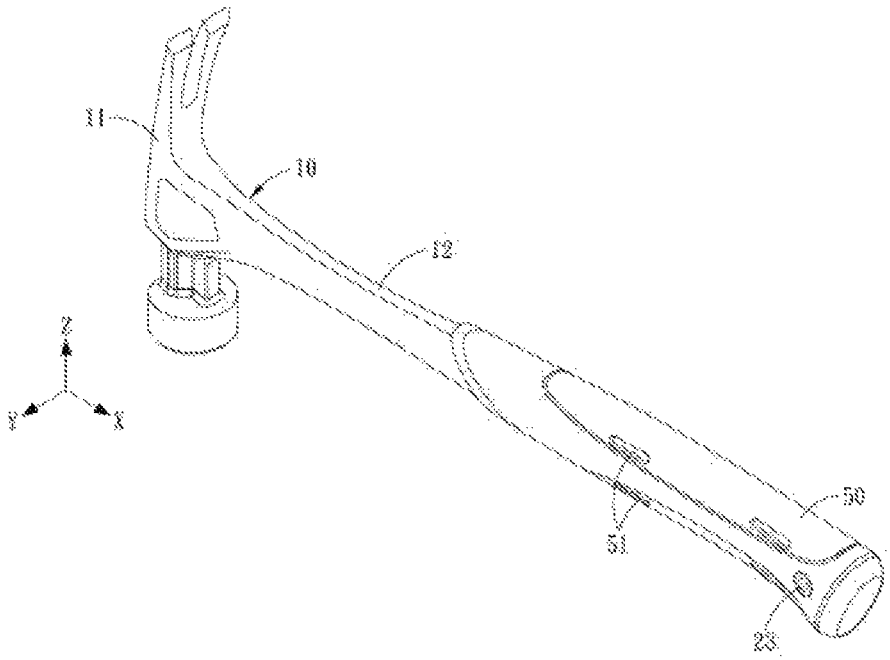
FIG. 1 is a perspective view of the hammering tool of the first example of the present invention.
Figure 2:
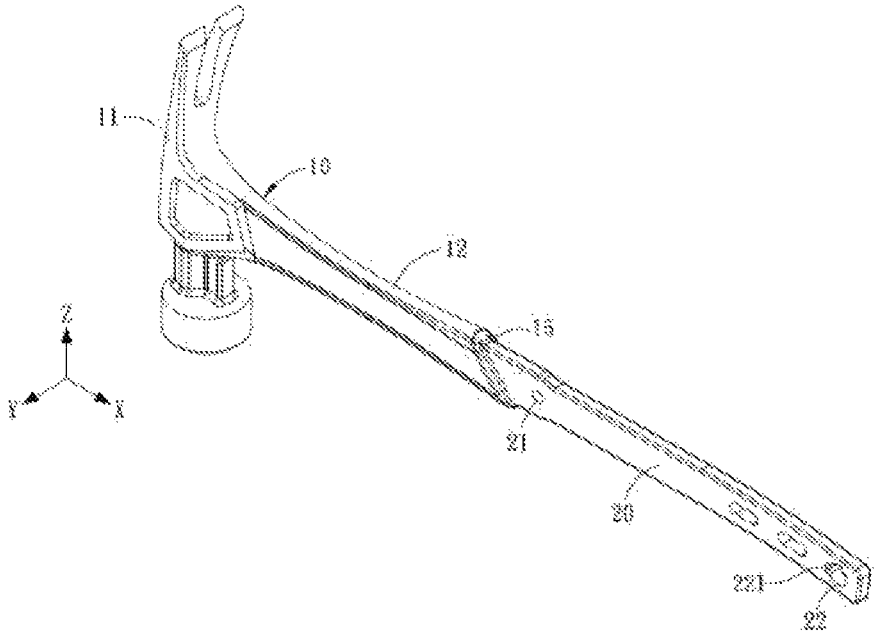
FIG. 2 is a perspective view of the hammerhead and the handle of the hammering tool of the first example of the present invention.

wherein,

10 hammerhead
11 head portion
12 handle portion
13 damping slot
14 damping material
15 stopping portion
20 inner core
21 assembly hole
22 locating hole
221 locating slot
23 locating pin
231 first pin member
232 second pin member
233 lug
30 external member
31 sleeve head portion
32 sleeve joint portion
33 through hole
34 punched hole
35 assembly part
40 inner damping layer
41 chamber
50 outer damping layer
51 inspection hole
52 accommodation space
53 opening
60 sealing cover
61 cover portion
62 inserting portion
63 fixing hole
X first direction
Y second direction
Z third direction.

DETAILED DESCRIPTION OF THE PREFERRED EMBODIMENTS

To facilitate the illustration, X, Y and Z shown in the figures indicates ae first direction, a second direction and a third direction respectively, and the first direction, the second direction and the third direction are perpendicular to each other.

The first preferred example of the present invention provides a hammering tool, wherein the hammering tool comprises a handle, as shown in FIGS. 1-4, the handle comprises an inner core 20 and a gripping portion disposed around the periphery of inner core 20, and at least one chamber 41 is formed between the inner core 20 and the gripping portion. The chamber 41 is disposed on at least one lateral side of the handle.

Preferably, the gripping portion comprises an outer damping layer 50, an inner damping layer 40 is disposed between the outer damping layer 50 and the inner core 20, and the chamber 41 is disposed in the inner damping layer 40. The inner damping layer 40 is prefabricated first and then sleeved on the inner core 20, or directly injection molded on the inner core 20 in an injection molding mode. The handle further comprises an external member 30, an assembly hole 21 is disposed on the inner core 20, and the external member 30 penetrates the assembly hole 21 and is fixed on the inner core 20 by an assembly part 35. The outer damping layer 50 is prefabricated first and then sleeved on at least one location of the inner damping layer 40 and/or the external member 30, or is directly injection molded on at least one location of the inner damping layer 40 and/or the external member 30 in an injection molding mode.

As shown in FIGS. 1-4, the hammering tool of the present example further comprises a hammerhead 10, which is disposed at the front end of the inner core 20 and may be made of metal material by integrally molding, but not limited to this. The hammerhead 10 has a head portion 11 a handle portion 12, the internal of the head portion 11 has at least one damping slot 13, a damping material 14 may be filled into the damping slot 13, and the damping material 14 may be silicone material or other soft damping materials. Preferably, the damping slot 13 may be provided at the central location of the internal of the head portion 11, so that the stress can be averaged and damped after the striking of the head portion 11. The head portion 11 is connected to one end of the handle portion 12, and the other end of the handle portion 12 is then continuously connected to the inner core 20. And a stopping portion 15 is disposed between the hammerhead 10 and the inner core 20, for confining the location of the external member 30.

The inner core 20 has an assembly hole 21 and a locating hole 22, the assembly hole 21 is provided at a location of the inner core 20 close to the stopping portion 15, and the locating hole 22 is provided at the rear end of the inner core 20.

The external member 30 has a sleeve head portion 31 and a sleeve joint portion 32 extended from the sleeve head portion 31, and the sleeve head portion 31 and the sleeve joint portion 32 are penetrated by a through hole 33. The shape of the through hole 33 matches the shape of the cross section of the inner core 20, to facilitate the external member 30 to be sleeved on the inner core 20 by the through hole 33. The sleeve joint portion 32 has a punched hole 34, the punched hole 34 and the assembly hole 21 correspond to each other, for the assembly part 35 to be equipped through and fixed.

Figure 3A:
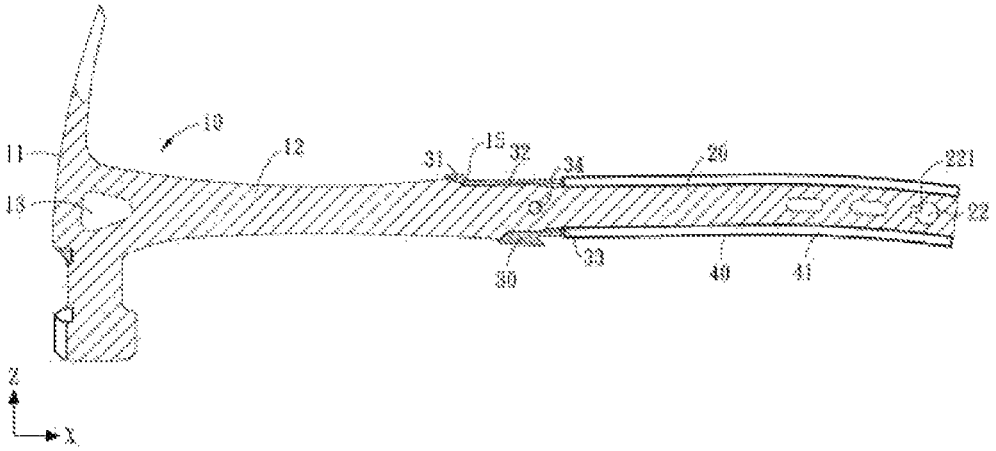
FIG. 3A and FIG. 3B are side sectional views of the hammering tool of the assembled first example of the present invention.

As shown in FIG. 3A, when the external member 30 is sheathed on the inner core 20 along the first direction X, the external member 30 may be pushed to the stopping portion 15 along the inner core 20 via the through hole 33, so that the sleeve head portion 31 of the external member 30 is limit stopped by the stopping portion 15, so that the sleeve head portion 31 and the stopping portion 15 are assembled with each other, and make the assembly hole 21 of the inner core 20 and the punched hole 34 of the sleeve joint portion 32 correspond to each other. The assembly part 35 is then equipped through the corresponding punched hole 34 and assembly hole 21 along the second direction Y, thereby the external member 30 is assembled on the inner core 20.

Figure 5A:
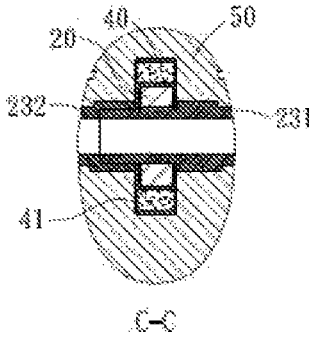
FIG. 5A is a sectional view of FIG. 3B of the present invention along A-A direction.
Figure 5B:
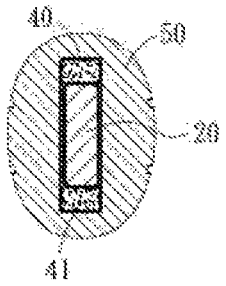
FIG. 5B is a sectional view of FIG. 3B of the present invention along B-B direction.
Figure 5C:
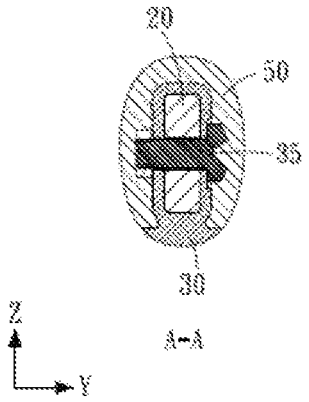
FIG. 5C is a sectional view of FIG. 3B of the present invention along C-C direction.

As shown in FIG. 5C, the assembly part 35 may be of a rivet structure or a bolt and nut structure, but not limited to this. With this structure design, the external member 30 is assembled to the inner core 20 along the first direction X, and the external member 30 is fixed to the inner core 20 by the assembly part 35 along the second direction Y, and since the second direction Y differs from the first direction X, it may prevent the external member 30 from detaching from the inner core 20 along the first direction X.

Figure 3B:
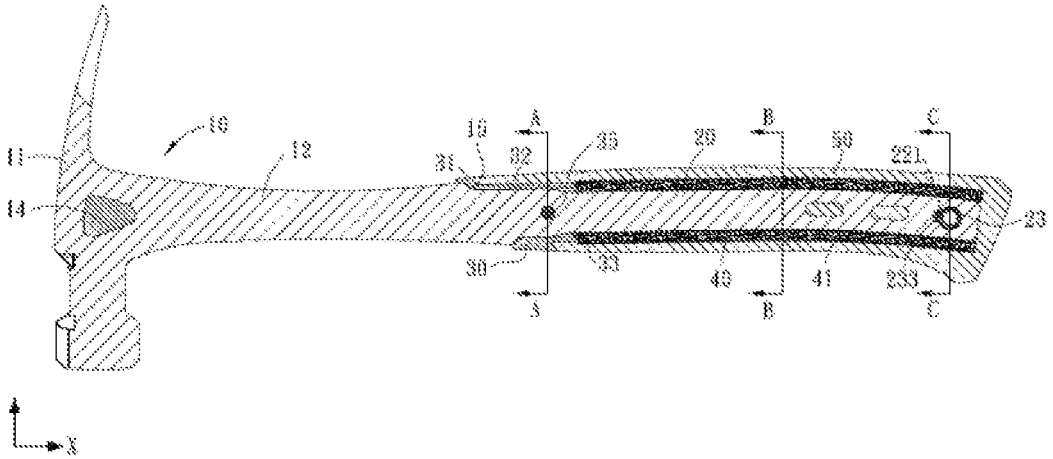
Figure 4:
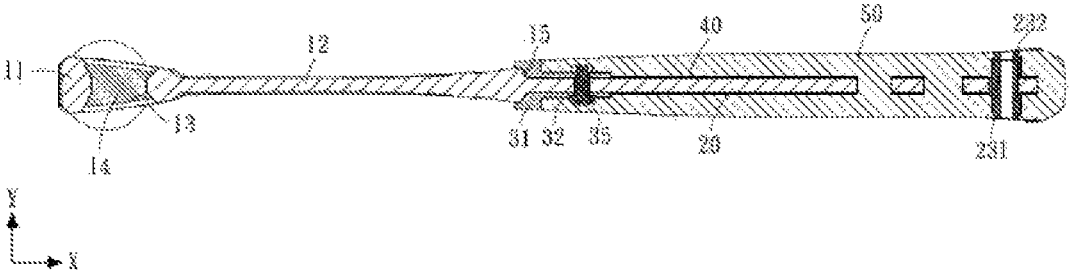
FIG. 4 is a top sectional view of the hammering tool of the first example of the present invention.

As shown in FIG. 3B, the locating hole 22 of the inner core 20 further comprises a locating slot 221, a locating pin 23 is equipped through the locating hole 22, and the locating pin 23 is composed of a first pin member 231 and a second pin member 232 jointed axially. On such basis: the first pin member 231 is longer than the second pin member 232, a lug 233 is disposed on the first pin member 231, and after the first pin member 231 and the second pin member 232 are joined axially and equipped through the locating hole 22, the lug 233 is embedded into the locating slot 221, to prevent the locating pin 23 from rotating axially in the locating hole 22.

The inner damping layer 40 forms a chamber 41 having a hollow part, and the inner damping layer 40 coats the inner core 20 and avoids the location of the external member 30, as shown in FIG. 5B, in this example, the inner damping layer 40 may be prefabricated first and then sleeved on the inner core 20, or the inner damping layer 40 is injection molded directly on the inner core 20 in an injection molding mode. The material of the inner damping layer 40 may be but not limited to thermoplastic polyurethane (TPU). The chamber 41 of the inner damping layer 40 is optionally disposed with damping material or airbag. When it is of airbag structure, compressed air or liquid substance may be further filled, so that elasticity is provided by utilizing the high air pressure or liquid substance in the chamber 41, for shock absorption and pressure reduction, but not limited to this. When the chamber 41 is filled with damping material, the damping material may optionally be liquid silicone or other liquid damping materials, but not limited to this. As shown in FIG. 5B, the chamber 41 of the inner damping layer 40 may be disposed to at least one lateral side of the inner core 20, and preferably, the chamber 41 of the inner damping layer 40 may be disposed to both upper and lower sides of the inner core 20.

Figure 6:
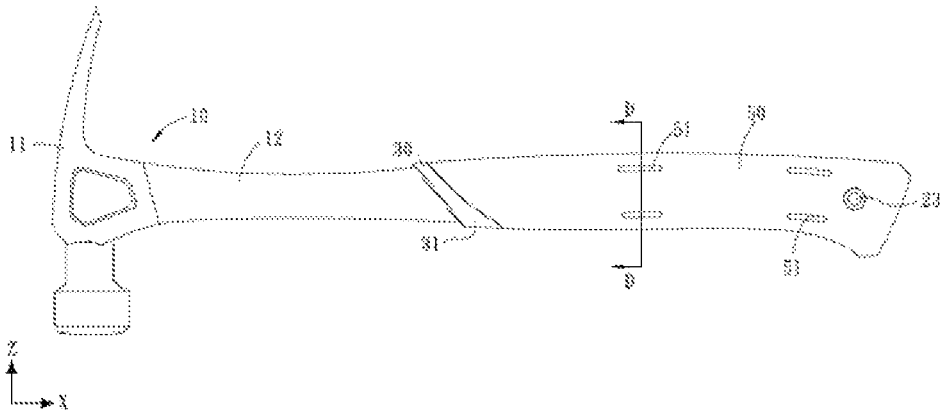
FIG. 6 is a side view of the hammering tool of the first example of the present invention.
Figure 7A:
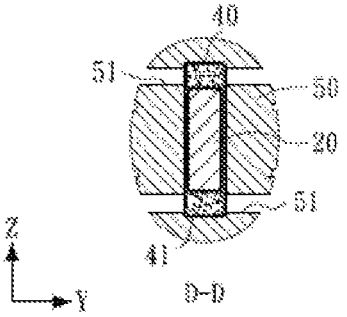
FIG. 7A and FIG. 7B are state schematic sectional views of FIG. 6 of the present invention along D-D direction.
Figure 7B:
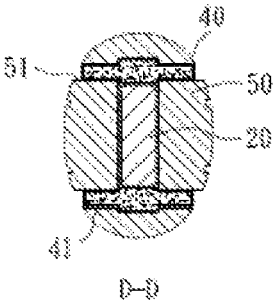

As shown in FIG. 3B, the inner damping layer 40 and the sleeve joint portion 32 of the external member 30 are coated by the outer damping layer 50. In this example, the outer damping layer 50 may be prefabricated first and then sleeved on the inner damping layer 40 and the sleeve joint portion 32 of the external member 30, or the outer damping layer 50 is directly injection molded on the inner damping layer 40 and the sleeve joint portion 32 of the external member 30 in an injection molding mode. The material of the outer damping layer 50 may be but not limited to thermoplastic polyurethane (TPU) or thermoplastic rubber material (TPR). As shown in FIG. 6, the outer damping layer 50 further comprises at least one inspection hole 51, which corresponds to at least one location of the inner damping layer 40, and the situation of rupture and leakage of the inner damping layer 30 and its chamber 41 may be observed via the inspection hole 51. As shown in FIG. 7A, it may be seen via the inspection hole 51 that no rupture and leakage is observed for the inner damping layer 30. As shown in FIG. 7B, if the rupture and leakage of the inner damping layer 30 occur, it can be seen via the inspection hole 51 that the inner damping layer 40 is leaked into the inspection hole 51 due to rupture.

Figure 8A:
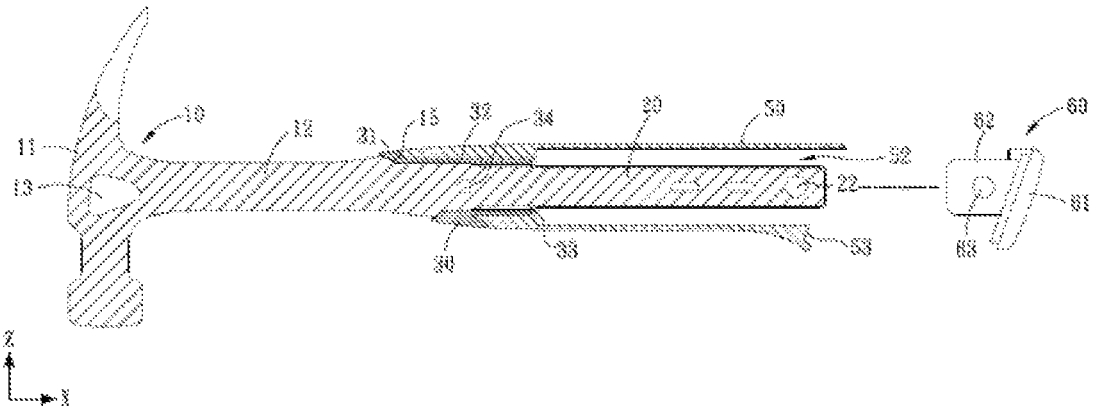
FIG. 8A and FIG. 8B are side sectional views of the hammering tool of the assembled second example of the present invention.
Figure 8B:
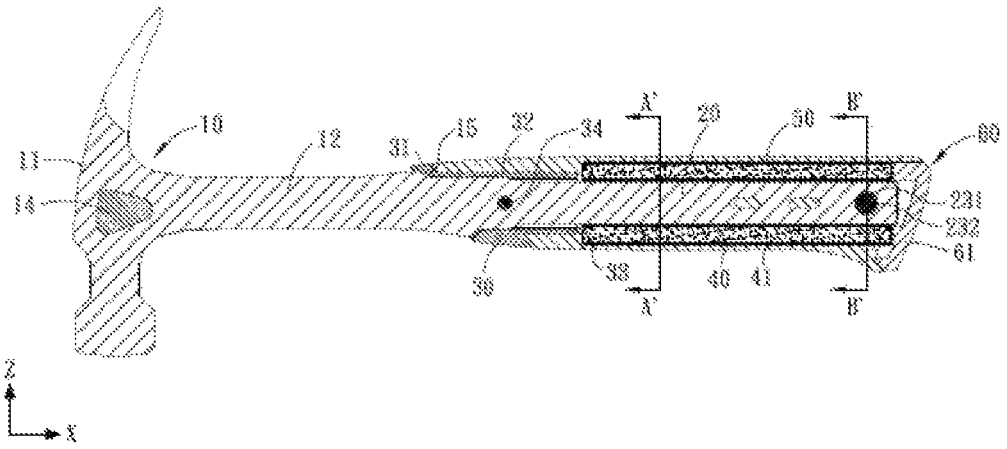

As shown in FIG. 8A and FIG. 8B, which are side sectional views of the assembled hammering tool of the second example of the present invention, the embodiment is substantially the same as the aforementioned first example, thus only differences will be described below, and other similarities will not be repeated.

Figure 9A:
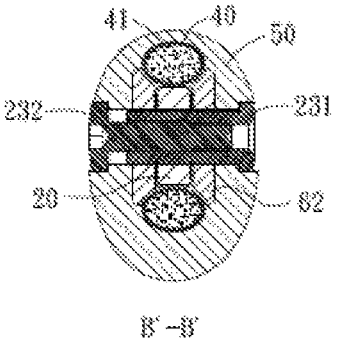
FIG. 9A is a sectional view of FIG. 8 of the present invention along A'-A' direction.
Figure 9B:
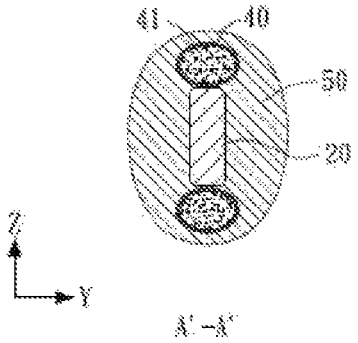
FIG. 9B is a sectional view of FIG. 8 of the present invention along B'-B' direction.

As shown in FIG. 8A, once the external member 30 is assembled to the inner core 20, the external member 30 may be fixed onto the inner core 20 by the assembly part 35, and then the outer damping layer 50 is prefabricated first and then sheathed on the sleeve joint portion 32 of the external member 30, or the outer damping layer 50 is directly injection molded on the sleeve joint portion 32 of the external member 30 in an injection molding mode. So that, an accommodation space 52 is provided between the outer damping layer 50 and the inner core 20. As shown in FIG. 8B, the inner damping layer 40 is further inserted into the accommodation space 52 and coats the inner core 20. As shown in FIG. 9A, preferably, the chamber 41 of the inner damping layer 40 may be disposed to both upper and lower sides of the inner core 20.

As shown in FIG. 8A-8B, subsequently, a sealing cover 60 is inserted at the opening 53 of the rear end of the outer damping layer 50. The sealing cover 60 has a cover portion 61 and at least one inserting portion 62 extended from the cover portion 61. The cover portion 61 is used to seal the opening 53 of the outer damping layer 50. The inserting portion 62 is inserted into the accommodation space 52 via the opening 53, and the inserting portion 62 has a fixing hole 63. Once the inserting portion 62 is assembled into the accommodation space 52, making the fixing hole 63 of the inserting portion 62 correspond to the locating hole 22 of the inner core 20, then the corresponding locating hole 22 and fixing hole 63 are equipped through by a locating pin 23 along the second direction Y, such that the sealing cover 60 is stably assembled at the rear end of the outer damping layer 50, preventing the sealing cover 60 from detaching from the rear end of the outer damping layer 50.

To sum up, according to the hammering tools disclosed by all examples of the present invention, when they are used for striking, the internal damping slot of the head portion may use the damping material as a first buffering and absorb the vibration and impact force of the hammerhead, which are then delivered to the inner core of the handle, the inner damping layer and its chamber serve as a second buffering and absorb the vibration and impact force delivered from the inner core of the handle, finally, the outer damping layer serves as a third buffering and absorbs the vibration and impact force delivered from the inner damping layer. The vibration and impact force felt by the hand of the user when in operation are dramatically decreased through these three buffering and damping structures.

In addition, the assembling direction (a first direction) of the external member relative to the inner core of the handle is different from the fixation direction (a second direction) of the assembly part fixing the external member, and the sleeve joint portion of the external member and the assembly part are further coated by the outer damping layer, thereby preventing the external member from detaching from the inner core of the handle from the assembly direction.

The preferred specific embodiments of the invention have been described in detail above. It should be understood that numerous modifications and variations can be made by those ordinary skilled in the art in accordance with the concepts of the present invention once they comprehend the concepts, specific embodiments and effects of the invention. Hence, the technical solutions that may be derived by those skilled in the art according to the concepts of the present invention on the basis of the prior art through logical analysis, reasoning and limited experiments should be within the scope of protection defined by the claims of the present invention.

The invention claimed is:

1. A handle, wherein the handle comprises an inner core and a gripping portion disposed around the periphery of the inner core, and at least one chamber is formed between the inner core and the gripping portion;

wherein the gripping portion comprises an outer damping layer, an inner damping layer is disposed between the outer damping layer and the inner core, and the chamber is disposed in the inner damping layer;

wherein the handle further comprises an external member, wherein the external member and the inner damping layer are respectively located in different parts of the inner core, and the external member wraps part of the inner core, and the inner damping layer wraps other part of the inner core, and then the outer damping layer wraps both of the external member and the inner damping layer; and wherein the external member further comprises a sleeve head portion having an internal diameter that is greater than an internal diameter of a sleeve joint portion.

2. The handle of claim 1, wherein the chamber is disposed on at least one lateral side of the handle.

3. The handle of claim 1, wherein a damping material or an airbag is disposed in the chamber.

4. The handle of claim 3, wherein the damping material is liquid silicone if the damping material is disposed in the chamber.

5. The handle of claim 3, wherein compressed air or liquid substance is filled in internal of the airbag if the airbag is disposed in the chamber.

6. The handle of claim 1, wherein the material of the outer damping layer is thermoplastic polyurethane or thermoplastic rubber material.

7. The handle of claim 1, wherein the material of the inner damping layer is thermoplastic polyurethane.

8. The handle of claim 1, wherein the inner damping layer is prefabricated first and then sleeved on the inner core, or is directly injection molded on the inner core in an injection molding mode.

9. The handle of claim 1, wherein the outer damping layer is prefabricated first and then sleeved on at least one location of the inner damping layer and/or the external member, or is directly injection molded on at least one location of the inner damping layer and/or the external member in an injection molding mode.

10. The handle of claim 1, wherein the external member is fixed on the inner core by an assembly part.

11. The handle of claim 10, wherein the external member is assembled onto the inner core along a first direction, the external member is assembled and fixed on the inner core by the assembly part along a second direction, and the first direction is different from the second direction.

12. The handle of claim 1, wherein the inner core has a locating hole, which is provided at the rear end of the inner core, and a locating pin is equipped through the locating hole, the locating pin is coated and fixed by the outer damping layer.

13. The handle of claim 12, wherein the locating hole further comprises a locating slot, the locating pin is composed of a first pin member and a second pin member jointed axially, and the first pin member has a lug, which is embedded into the locating slot, to prevent the locating pin from rotating axially in the locating hole.

14. The handle of claim 1, wherein the outer damping layer further comprises at least one inspection hole, which penetrates the outer damping layer and corresponds to at least one location of the inner damping layer, for observing the inner damping layer and the chamber.

15. The handle of claim 1, wherein the outer damping layer is prefabricated first and then sheathed on at least one location of the external member, or is directly injection molded on at least one location of the external member in an injection molding mode.

16. The handle of claim 15, wherein an accommodation space is provided between the outer damping layer and the inner core, and the accommodation space is stuffed by the inner damping layer.

17. The handle of claim 16, wherein the inner core has a locating hole, which is provided at a rear end of the inner core, a locating pin is equipped through the locating hole, and the locating pin is coated and fixed by the outer damping layer.

18. The handle of claim 17, wherein the rear end of the outer damping layer is connected to a sealing cover, the sealing cover comprises:

a cover portion, for sealing the opening of the outer damping layer; and at least one inserting portion, extending out from the cover portion, the inserting portion is inserted into the accommodation space via the opening, and the inserting portion is coated and fixed by the outer damping layer.

19. A hammering tool, wherein the hammering tool comprises a handle, wherein the handle comprises an inner core and a gripping portion disposed around the periphery of the inner core, and at least one chamber is formed between the inner core and the gripping portion;

wherein the gripping portion comprises an outer damping layer, an inner damping layer is disposed between the outer damping layer and the inner core, and the chamber is disposed in the inner damping layer;

wherein the handle further comprises an external member, wherein the external member and the inner damping layer are respectively located in different parts of the inner core, and the external member wraps part of the inner core, and the inner damping layer wraps other part of the inner core, and then the outer damping layer wraps both of the external member and the inner damping layer;

wherein the external member further comprises a sleeve head portion having an internal diameter that is greater than an internal diameter of a sleeve joint portion; and the hammering tool further comprises a hammerhead connected to the inner core of the handle.

20. The hammering tool of claim 19, wherein the hammerhead and the inner core are integrally molded.

21. The hammering tool of claim 19, wherein a internal of the hammerhead has at least one damping slot, and the damping slot is used for stuffing with damping material therein.

22. The hammering tool of claim 19, wherein a stopping portion is disposed between the hammerhead and the inner core, and the stopping portion is used to confine a location of the external member sheathed on the inner core.

23. The hammering tool of claim 22, wherein the external member further comprises:

the sleeve head portion, which is limited by the stopping portion and thereby assembled with the stopping portion;

the sleeve joint portion, which is extended out from the sleeve head portion; and a through hole, penetrating the sleeve head portion and the sleeve joint portion, and the through hole is used for the inner core to be equipped through therein.

* * * * *